US005560603A

United States Patent [19]

Seelig et al.

[11] Patent Number: 5,560,603

[45] Date of Patent: Oct. 1, 1996

[54] COMBINED SLOT MACHINE AND RACING GAME

[75] Inventors: Mac R. Seelig; Jerald Seelig, both of Absecon; Michael Hiltebrand, Pedricktown; Douglas Cramer, Somers Point, all of N.J.

[73] Assignee: Atlantic City Coin & Slot Service Company, Inc., Pleasantville, N.J.

[21] Appl. No.: 543,200

[22] Filed: Oct. 13, 1995

Related U.S. Application Data

[63] Continuation-in-part of Ser. No. 488,270, Jun. 7, 1995.

[51] Int. Cl.[6] ..... G07F 17/34; A63F 9/14

[52] U.S. Cl. ..... 463/6; 273/143 R; 463/20; 463/25; 463/60; 463/42

[58] Field of Search ..... 273/143 R, 138 A, 273/138 R, 86 B, 85 G, 85 CP

[56] References Cited

U.S. PATENT DOCUMENTS 2,671,662 3/1954 Carpenter ..... 273/86 B 5,398,938 3/1995 Money ..... 273/237

FOREIGN PATENT DOCUMENTS 388103 9/1990 European Pat. Off. ..... 273/86 B 2066991 7/1981 United Kingdom ..... 273/143 R 2251558 7/1992 United Kingdom ..... 273/86 B

*Primary Examiner*—Benjamin H. Layno

*Attorney, Agent, or Firm*—Norman E. Lehrer; Jeffrey S. Ginsberg

[57] ABSTRACT

The gaming system of the present invention includes one or more slot machines associated with a racing display wherein the racing elements are not racing against each other. Rather, a clock is included and each racing element is racing against the clock, independently of the other racing elements. The racing display may be built directly into the slot machine so that the slot player can easily see the progress of his horse or other racing element. Alternatively, a large racing display may be utilized that displays a plurality of horses or other racing elements but wherein each horse is racing against a different clock rather than against each other. Even further, Win, Place and Show positions are located adjacent the finish line and the slot player whose horse reaches either of these positions is awarded a prize depending on the position reached before the clock has timed out.

6 Claims, 2 Drawing Sheets

COMBINED SLOT MACHINE AND RACING GAME

CROSS-REFERENCE TO RELATED APPLICATION

This application is a continuation-in-part of prior application Ser. No. 488,270, filed Jun. 7, 1995.

BACKGROUND OF THE INVENTION

The present invention is directed toward a gaming system and, more particularly, toward such a system that combines a slot machine with a racing display that may be built directly into the slot machine or which may be remote therefrom.

As explained in Applicants' prior pending application, traditional slot machines common in use are normally stand-alone devices intended to be played by a single player. The player inserts one or more coins therein and either pushes a button or pulls a lever to initiate the play. Depending on the final position of the spinning wheels within the slot machine, the machine determines whether or not and how much the player has won.

Applicants' prior application describes a system wherein a plurality of slot machines may be combined together with a large, overhead racing display which carries a number of racing elements such as automobiles, horses or the like. Each time one of the slot machines wins or each time the handle is pulled or a coin is played, the respective racing element is moved a predetermined distance. Whichever horse or other racing element wins the race, the player at that slot machine is awarded a bonus. The primary purpose of the invention described in the prior invention is to encourage competition between slot players.

While the invention described in Applicants' prior invention may serve the purpose indicated therein, it also can create certain difficulties. Since the horses or other racing elements are racing against each other, all of the slot players must begin at precisely the same time. This would require supervision by an operator or other person which obviously creates additional expense. Even further, a number of the slot machines would be sitting idle and, therefore, not generating income to the casino while waiting for other players so that the race could begin.

Furthermore, because the racing display described in the prior application was remotely located from the slot machine, it might be difficult for the slot players to view the same while playing the slot machine. This might discourage them from playing. Even further, the system described in the prior application suggested that a prize be awarded to the winning horse. As a result, should one of the horses win relatively early in the race because the particular slot machine has "hit" an inordinate number of times, the remaining slot players in the race would stop playing, thereby creating a loss in revenues to the casino operator.

SUMMARY OF THE INVENTION

The present invention is intended to overcome the apparent deficiencies in the invention described in Applicants' prior application discussed above and provides a system which will encourage the slot players to continue playing and which is entertaining to both the players themselves and to others who may be watching. The gaming system of the present invention includes one or more slot machines associated with a racing display wherein the racing elements are not racing against each other. Rather, a clock is included and each racing element is racing against the clock, independently of the other racing elements. The racing display may be built directly into the slot machine so that the slot player can easily see the progress of his horse or other racing element. Alternatively, a large racing display such as described in the prior application may also be utilized but wherein each horse is racing against a different clock rather than against each other. Even further, Win, Place and Show positions are located adjacent the finish line and the slot player whose horse reaches either of these positions is awarded a prize depending on the position reached before the, clock has timed out.

DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
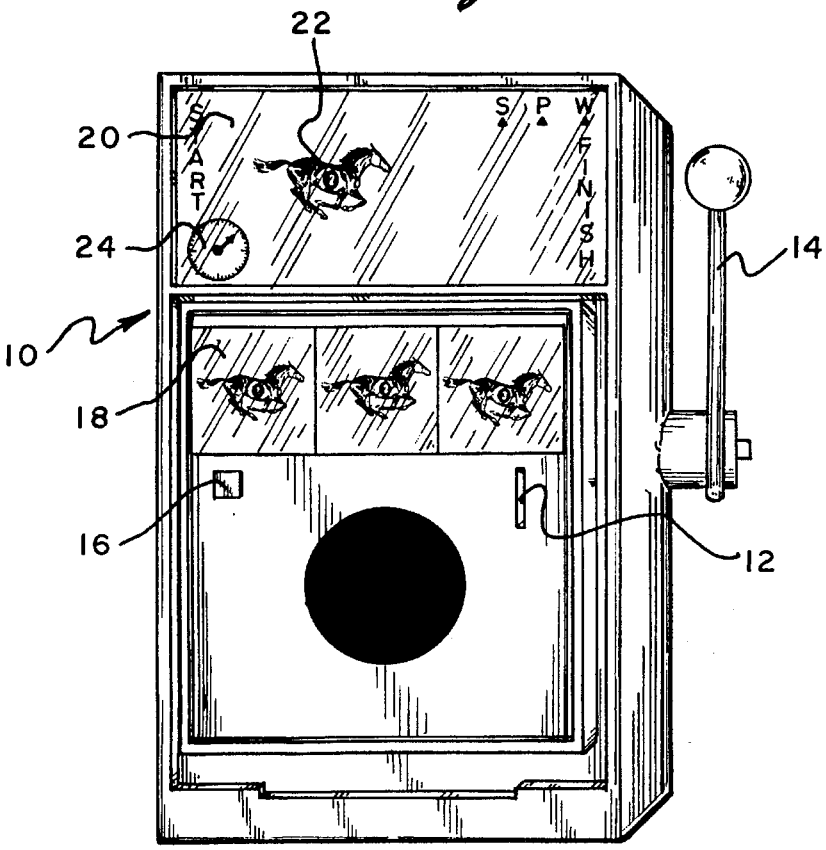
FIG. 1 is a representation of a combined slot machine and racing game in accordance with the principles of the present invention.

Referring now to the drawings in detail wherein like reference numerals have been used throughout the various figures to designate like elements, there is shown in FIG. 1 a combined slot machine and racing game constructed in accordance with the principles of the present invention and designated generally as 10. With the exception of certain modifications and additional features described hereinafter, the slot machine 10 is generally of conventional construction and includes a coin slot 12 and a lever arm 14. The slot machine 10 may also include a push button 16 that can be activated in order to initiate play in lieu of the lever arm 14. The slot machine 12 also includes a display window 18 wherein the results of each play on the machine can be viewed.

Slot machine 10 may be either of the conventional mechanical type with rotating or spinning wheels or of the more modern electronic type of machine wherein only the appearance of rotating wheels is displayed in the display window 18. While three such rotating wheels are shown in slot machine 10, it should be readily apparent that other types of slot machines having fewer or greater numbers of wheels could also be utilized. Furthermore, while the term "rotating wheel" or "spinning wheel" may be used in this application, it should be understood that the term is intended to refer to both mechanical wheels that rotate and the electronic type of displays that merely simulate rotating wheels.

Located in the upper portion of the front of the slot machine 10 is a racing display 20. Racing display 20 includes a racing element such as a horse 22 which is capable of moving across the display 20 from the left to the right. The racing element 22 and the display 20 can either be of the mechanical type wherein a stepping motor and drive chain or the like physically move the horse 22 through a predetermined distance each time a command is received to do so or electrical or electronic types of displays can be utilized such as are more fully described in Applicants' parent application referred to above.

The slot machine 10 also includes a clock or other timing mechanism and a timer display such as shown at 24. The timer display 24 can be either of the analog type or can be a digital display and is preferably arranged to count down. That is, the timer display 24 is preferably arranged so as to initially display a fixed amount of time such as five minutes or the like and then "counts down," i.e. displays continuously lower numbers as time elapses.

On the finish or right side of the display 20 are three distinct markings S, P and W which represent "Show," "Place" and "Win." As shown, the Show position is furthest from the finish line and closest to the start line while the Win position is preferably at the finish line and the Place position is between the Show and Win positions.

A player utilizes the slot machine 10 in a conventional manner. That is, one or more coins are inserted into the coin slot 12 and the lever 14 is pulled or the button 16 is depressed to begin spinning the wheels 18. The first coin played and/or the pulling of the handle 14 or the pushing of the button 16 also initiates the timer display 24. That is, timer display 24 resets to five minutes or some, other predetermined time and begins counting down. Furthermore, initiation of the play also resets the racing element such as the horse 22 to the start position. Alternatively, a separate button or the like which, when depressed, can be utilized to reset the timer display 24 and the racing element 22 to await the first coin or the first pull of the handle 14.

After the rotating wheels 18 stop, the slot machine 10 may or may not pay out coins to the player (or award credits) depending on the specific combination of indicia that appear. In this regard, the slot machine 10 functions in a conventional manner to provide a monetary payment to the player when certain predetermined combinations of the indicia on the wheels is displayed.

Each time a particular predetermined combination of indicia appears in the display 18, a signal is generated which advances the racing element 22 through a particular predetermined distance. Different combinations of the indicia on the wheels 18 could, of course, be selected to move the racing element through different distances. Preferably, the particular combination of indicia on the wheels in display 18 that provides the player with a monetary payment is not a combination which moves the racing element 22. Conversely, the particular preselected combination of indicia that moves the racing element 22 preferably does not provide the player with a monetary payment. This adds excitement and interest to continuing the play of the game since a player has an opportunity to win his race even if the slot machine does not pay during any particular pull of the handle 14.

The timer display 24 continues to count down as the player plays the slot machine 10. Each time that the predetermined combination of indicia such as the three horses shown on the display 18 appears, the racing element 22 moves toward the finish line. The principal object of this aspect of the slot machine 10 is, of course, to attempt to have the player's horse 22 reach the finish line before the timer display 24 times out. Once the timer display 24 does time: out, the game is over and means are provided for sensing the position of the racing element 22. If the horse has reached the Show line, a prize is awarded. This may be done through the slot machine 10, i.e. by paying additional coins to the player in the conventional manner or a separate award or prize may be given to the player by the proprietor. If the horse 22 has reached the Place position, a prize is also awarded which preferably is of a greater value than the Show prize. Should the horse 22 reach the Win line before the timer display 24 times out, an even greater prize is awarded.

Figure 2:
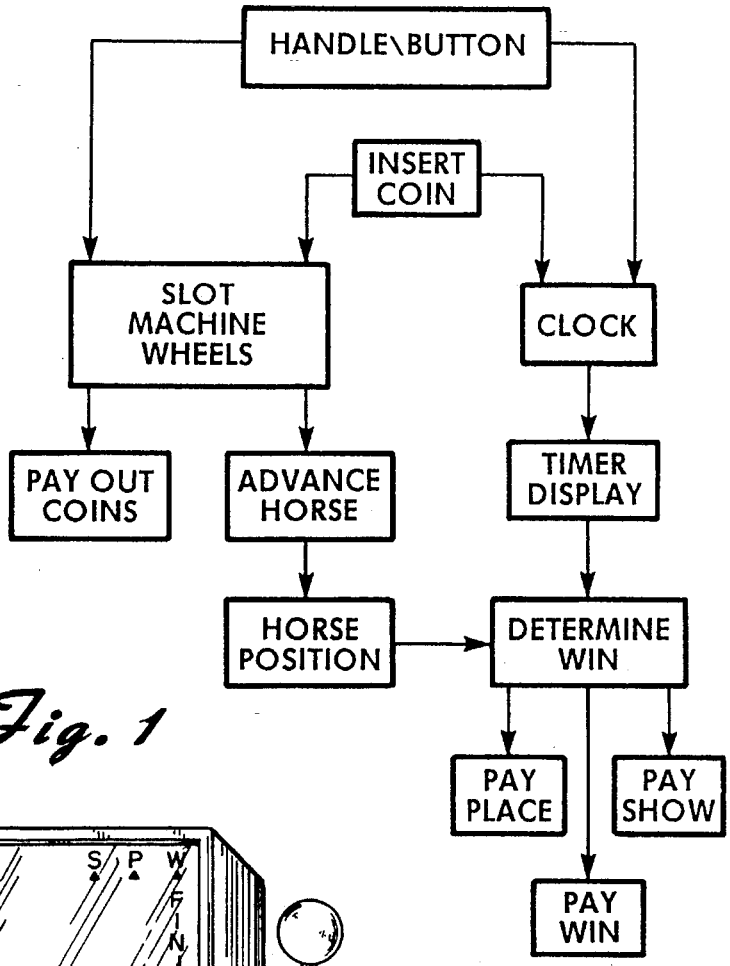
FIG. 2 is a flow chart showing the operation of the invention.

FIG. 2 is a combined schematic and logic diagram essentially illustrating the progression of the play of the game as outlined above. In summary, when a coin is inserted, the clock initiates the timer display and the slot machine wheels are initiated so that they will rotate upon the pull of the handle or push of the button. Depending on the particular combination of indicia on the wheels when they stop rotating, either coins will be paid out in the conventional manner or the racing element will advance. When the timer display times out, the position of the racing element is determined and appropriate payment is made if the racing element reaches the Win, Place or Show position.

Figure 3:
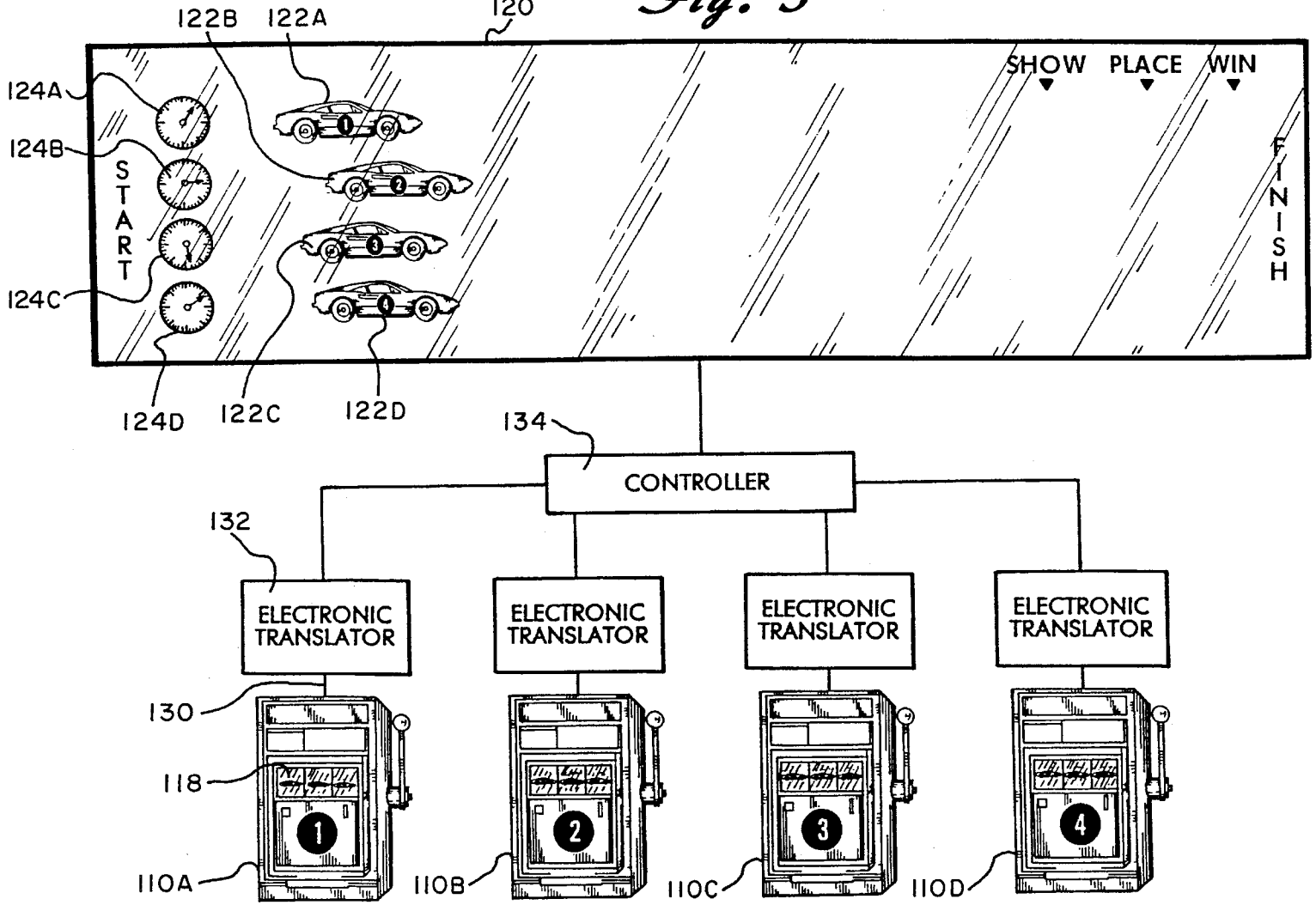
FIG. 3 is an overall view, partly in schematic form, of a second embodiment of the invention including a plurality of slot machines and racing elements.

FIG. 3 illustrates a modified form of the invention described above. In this embodiment of the invention, a plurality of slot machines are utilized such as shown at 110A, 110B, 110C and 110D. While four such slot machines are shown, it should be readily apparent that a fewer or greater number of machines may be utilized.

Located above the series of slot machines is a racing display 120. Preferably, the racing display 120 is located in a position which, while remote from the slot machines, is capable of being easily viewed by the players of the slot machines and by other spectators who may gather around. The racing display 120 includes a plurality of racing elements thereon such as shown at 122A, 122B, 122C and 122D. Each racing element corresponds with a particular slot machine. The slot machines 110A–110D and the racing elements 122A–122D are arranged and operate in a manner very similar to that described in Applicants' parent application incorporated herein by reference. That is, when a certain condition of play is sensed in slot machine 110A such as the appearance of three horses on the rotating wheels 118, an output signal is generated on line 130. Line 130 is connected to an electronic translator circuit 132 which interprets the output signal and converts the same to a useful electrical signal such as a current pulse or a series of pulses which are, in turn, delivered to the controller circuit 134. The controller circuit 134 is, in turn, connected to the racing display 120 and a particular racing element such as racing element 122A is then advanced by a predetermined distance. As with the display 20, the racing display 120 can either be of the mechanical type such as shown or of an electronic or electrical type.

Each slot machine and each racing element is provided with its own timer display such as shown at 124A, 124B, 124C and 124D at the left side of the racing display 120. Thus, instead of racing against the other slot machine players, each player is racing against his or her own clock. The player will win or lose depending on whether his or her respective car or other racing element 122A–122D reaches the Win, Place or Show line before his or her timing display times out. A particular timing display is initiated when the player begins to play on the corresponding slot machine in the manner described above with respect to the embodiment of the invention shown in FIG. 1. In this way, it is not necessary for all of the players to begin at the same time. As a result, the slot machines will be in more continuous use.

It should be readily apparent that it is also possible to combine the features of the slot machine 10 shown in FIG.

1 with the arrangement shown in FIG. 3. That is, each of the slot machines 110A–110B could also include its own racing display so that the player can more easily watch his or her racing element without having to look up at the main racing display 120. Each slot machine 110A–110D may also have its own timer display which would correspond exactly to the timer displays 124A–124D or which may be used in lieu of the timer displays 124A–124D so that the player can again more easily keep track of his or her remaining time.

The present invention may be embodied in other specific forms without departing from the spirit or essential attributes thereof and accordingly reference should be made to the appended claims rather than to the foregoing specification as indicating the scope of the invention.

We claim:

1. A gaming system comprising:

a slot machine including means for accepting one or more coins to be bet in said machine, said machine including a plurality of rotating wheels with indicia thereon and a plurality of windows corresponding to the number of said wheels for exhibiting the indicia on said wheels after they have stopped rotating;

said slot machine including means for making a monetary payment to a player when said means for exhibiting displays a predetermined combination of said indicia on said wheels;

a racing display including a movable racing element thereon and means for moving said racing element;

said slot machine further including a means for generating an output signal when said exhibiting means displays a second predetermined combination of indicia;

means connecting said output signal to said moving means whereby said output signal functions to move the racing element through a predetermined distance;

clock means and elapse time display means connected to said clock means;

means for rewarding the player if the racing element reaches a predetermined position within a predetermined time interval determined by said clock means.

2. The system as claimed in claim 1 wherein said display means is contained within said slot machine.

3. The system as claimed in claim 1 wherein said means for rewarding said player includes means for providing said player with a plurality of different awards, the value of which depends on the position of said racing element at the end of said time interval.

4. The invention as claimed in claim 3 wherein said display means includes three distinct markings thereon indicating a Win position, a Place position and a Show position and wherein said means for rewarding rewards a greater amount when said racing element reaches said Win position and lesser amounts if said racing element reaches said Place or Show positions.

5. The system as claimed in claim 1 wherein said racing display is located remote from said slot machine.

6. The system as claimed in claim 5 further including a plurality of said slot machines and a plurality of racing elements carried by said racing display means, the number of said racing elements being equal to the number of said slot machines with each element being associated with a different one of said slot machines.

* * * * *